United States Patent [19]

Roccaforte

[11] 4,378,905

[45] Apr. 5, 1983

[54] CARTON WITH STRAP HANDLE AND BLANK FOR FORMING SAME

[75] Inventor: Harry I. Roccaforte, Western Springs, Ill.

[73] Assignee: Champion International Corporation, Stamford, Conn.

[21] Appl. No.: 299,659

[22] Filed: Sep. 8, 1981

Related U.S. Application Data

[63] Continuation-in-part of Ser. No. 253,011, Apr. 10, 1981, abandoned.

[51] Int. Cl.[3] ..... B65D 5/46; B65D 25/28

[52] U.S. Cl. ..... 229/52 B; 150/12; 220/94 A

[58] Field of Search ..... 229/52 B; 150/12; 220/94 A

[56] References Cited

U.S. PATENT DOCUMENTS

| | | | |
|---|---|---|---|
| 2,868,433 | 1/1959 | Anderson | 229/52 B |
| 2,955,739 | 10/1960 | Callura | 229/52 B |
| 2,986,324 | 5/1961 | Anderson | 229/52 B |
| 3,094,268 | 6/1963 | Swanson | 229/52 B |
| 3,164,316 | 1/1965 | Wurster | 229/52 B |
| 3,994,432 | 11/1976 | Kerley | 229/52 B |
| 4,109,849 | 8/1978 | Wood | 229/52 B |
| 4,121,757 | 10/1978 | Hardin | 229/52 B |

*Primary Examiner*—Herbert F. Ross

*Attorney, Agent, or Firm*—Evelyn M. Sommer; John H. Mulholland

[57] ABSTRACT

A carton has a handle formed on its top. The carton comprises top and bottom walls connected by a tubular body. The top wall has inner and outer panels extending from opposite sides of said tubular body and being overlapped and secured together. An elongated handle panel is formed from a portion of the outer top panel, and is substantially equally spaced from the tubular body opposite sides. A score line is formed in the outer top panel to define the handle panel, which score line extends substantially parallel to a free end edge of the outer top panel and at least to the tubular body. This handle panel lies flat against the top wall of the carton while it is shipped and stored, and is readily accessible by tearing along the score line. The handle panel is oriented to lift the carton in line with the carton center of gravity to avoid tilting of the carton.

3 Claims, 9 Drawing Figures

CARTON WITH STRAP HANDLE AND BLANK FOR FORMING SAME

CROSS-REFERENCE TO RELATED APPLICATION

This application is a continuation-in-part of U.S. patent application Ser. No. 253,011 filed Apr. 10, 1981 now abandoned.

BACKGROUND OF THE INVENTION

1. Field of the Invention

The present invention relates to a carton having a handle formed on its top wall, and a blank for forming the carton. More particularly, the invention relates to a handle arrangement which is centrally located on the carton top wall, is aligned with the carton center of gravity and can be easily separated from the carton top wall along a score line.

2. Description of the Prior Art

Cartons or containers for large quantities of consumer articles are often provided with a handle to facilitate carrying the carton with its contents. Preferably, this handle is formed from a unitary portion of the blank used to form the remainder of the carton to simplify construction of the carton and to minimize expenses. For cartons containing relatively heavy articles, such as 24 cans of beer or other beverages, the carton must be sufficiently strong to withstand the considerable weight of the carton and its contents.

In one known carton, the handle comprises two U-shaped panels which overlie one another and extend angularly outwardly from one of the top edges of the carton. Since the handle extends from an edge of the carton, it is offset from the center of gravity of the carton causing the carton to hang at an angle when held by the handle. The angular hanging of the carton makes carrying difficult and interfers with walking. This carton is also defficient in not having a suitably strong handle arrangement. Further, the angular extension of the handle interfers with packing.

SUMMARY OF THE INVENTION

Accordingly, it is an object of the present invention to provide a carton and a blank for forming a carton with a handle located in the center of the carton top and aligned with the carton center of gravity to distribute the load of the carton evenly when held by the handle.

Another object of the present invention is to provide a carton and a blank for forming a carton with a handle which lies flat against the carton top during shipping and storage prior to being used as a handle to facilitate stacking of a plurality of similarly constructed cartons.

An additional object of the present invention is to provide a carton and a blank for forming a carton with a handle which carton forms a sealed container for the contents.

A further object of the present invention is to provide a carton and a blank for forming a carton with a handle which is readily accessible to the consumers.

Yet another object of the present invention is to provide a carton and a blank for forming a carton with a handle which is of rugged construction and which is simple and inexpensive to manufacture, assemble and use.

The foregoing objects are obtained by providing a carton comprising top and bottom walls which are connected by a tubular body. The top wall has inner and outer panels extending from opposite sides of the tubular body, which panels are overlapped and secured together. An elongated handle panel is formed from a portion of the outer top panel and is substantially equally spaced from the tubular body opposite sides. The handle panel is defined by a score line formed in the outer top panel which extends substantially parallel to a free end edge of the outer top panel and at least to the tubular body.

The foregoing objects are also obtained by a blank for forming a carton comprising a front panel, inner and outer top panels, a bottom panel and a back panel. The inner top panel is hingedly coupled to an end edge of the front panel along a fold line. The bottom panel is hingedly coupled to an end edge of the front panel remote from the inner top panel along a fold line. The back panel is hingedly coupled to an end edge of the bottom panel remove from the front panel along a first fold line. The outer top panel is hingedly coupled to an end edge of the back panel remote from the bottom panel along a fold line. A score line formed in the top outer panel extends parallel to the first fold line completely across the top outer panel and is spaced from the first fold line and a free edge of the top outer panel.

By forming the carton and the blank of the present invention in this manner, a carton has a handle which is centered on the top wall of the carton and aligned with the center of gravity of the carton. Since the handle is formed from an end portion of the outer top wall panel, the carton may be completely sealed. The score line holds the handle flat against the carton to facilitate shipping and storage, while permitting the handle to be readily accessible to the consumer by merely tearing along the score line. Thus, the present invention provides a carton formed with a rugged handle which can be easily and economically manufactured, shipped, stored and used.

Other objects, advantages and salient features of the present invention will become apparent when the following detailed description, which taken in conjunction with the annexed drawings, discloses a preferred embodiment of the present invention.

As used in this application, the terms "first", "second", "end", "side", "front", "back", "top" and "bottom" are intended to facilitate the description of the carton and the blank for forming the carton. Thus, such terms are merely illustrative of the carton and the blank and are not intended to limit the carton or blank to any specific orientation.

BRIEF DESCRIPTION OF THE DRAWINGS

Referring to the drawings which form part of this original disclosure.

DETAILED DESCRIPTION OF THE PREFERRED EMBODIMENT OF THE INVENTION

Figure 1:
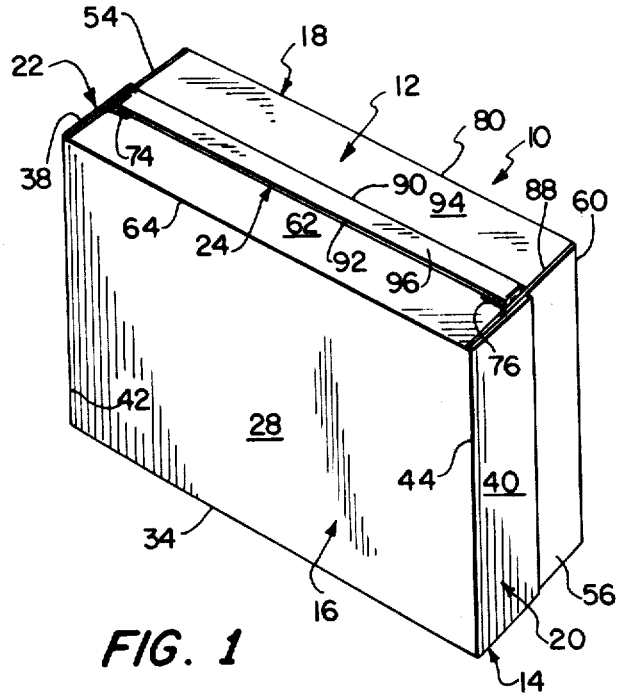
FIG. 1 is a perspective view illustrating the carton of the present invention with the handle in its stored position.

Referring to FIG. 1, carton 10 in its assembled configuration has a top wall 12, a bottom wall 14, a front wall 16, a back wall 18 and two side walls 20, 22. These walls are rectangular in shape to define a rectangular parallelepiped and are coupled along their adjacent edges.

An elongated handle panel 24 is provided on top wall 12 and extends parallel to front and back walls 16, 18 and perpendicular to side walls 20, 22. Handle panel 24 is centered on top wall 12 in that it is substantially equally spaced from front and back walls 16, 18. The longitudinal axis of handle panel 24 lies in a plane parallel to front and back walls 16, 18 and containing the center of gravity of carton 10.

Figure 2:
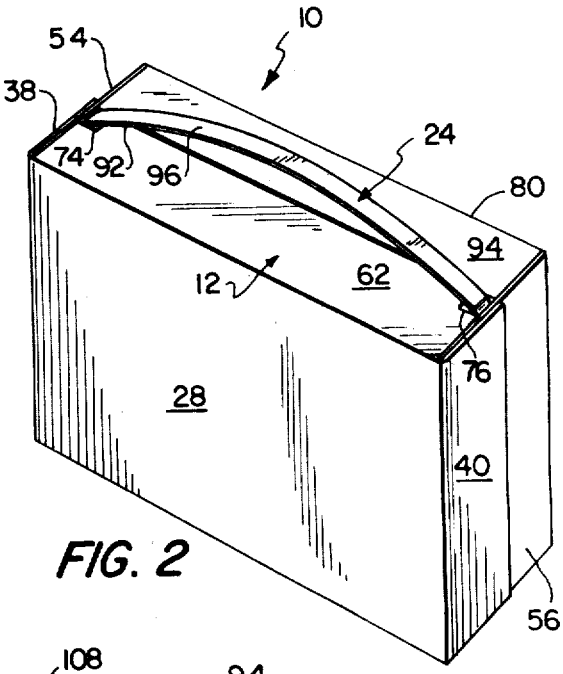
FIG. 2 is a perspective view illustrating the carton of FIG. 1 with the handle in its operative position.
Figure 3:
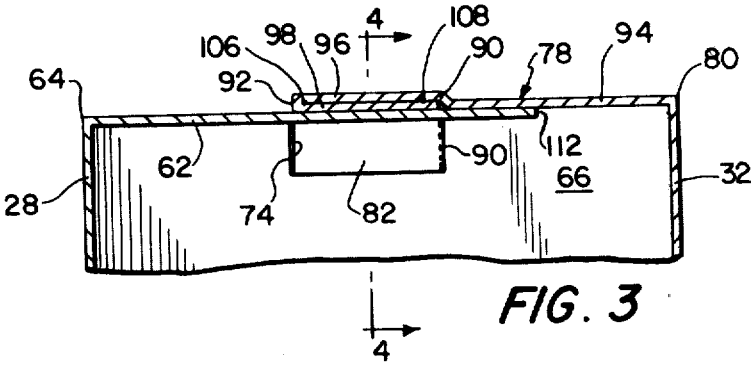
FIG. 3 is a partial, side elevational view illustating the carton of FIG. 1 according to a first embodiment of the invention in cross section taken along lines 3—3 of FIG. 4.
Figure 4:
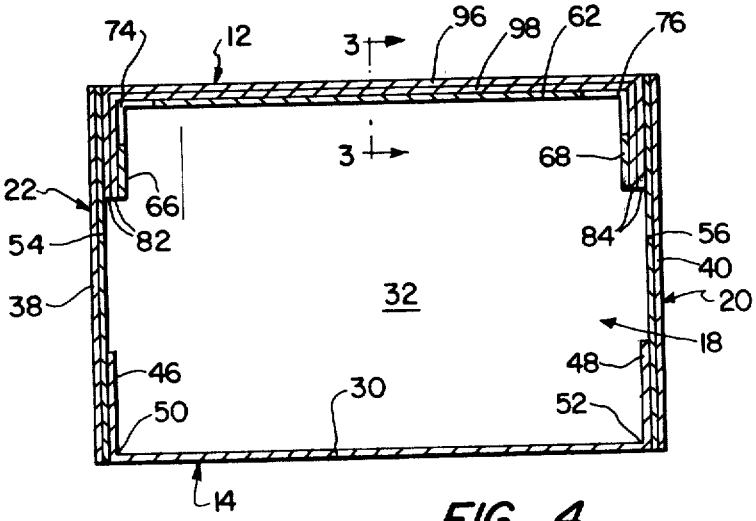
FIG. 4 is a front elevational view illustrating the carton of FIG. 1 in cross section taken long lines 4—4 of FIG. 3.

To facilitate storage and shipping, handle panel 24 initially lies flat against top wall 12 as illustrated in FIGS. 1, 3 and 4. When the consumer needs to carry carton 10 by handle panel 24, the consumer separates handle panel 24 from the remainder of top wall 12 as illustrated in FIG. 2.

Figure 5:
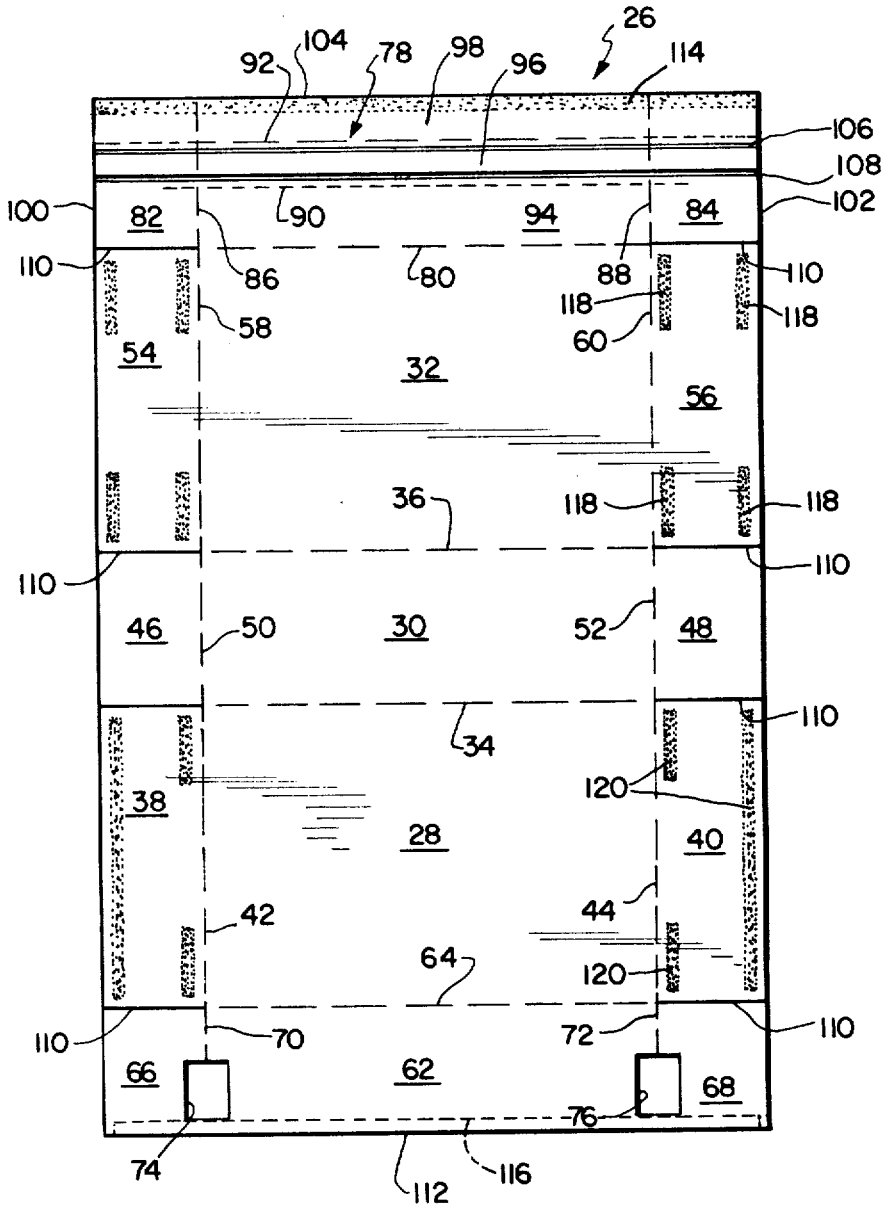
FIG. 5 is a plan view illustrating the interior surface of a blank for forming the carton of FIG. 1 according to a first embodiment of the invention.

The planar, unitary blank 26 for forming carton 10 is illustrated in FIG. 5. Blank 26 can be formed of a unitary piece of paperboard of suitable weight and thickness. The weight and thickness of the paperboard depends on the size and weight of the articles contained within carton 10. FIG. 5 illustrates the surface of blank 10 which will form the interior surface of carton 10 illustrated in FIG. 1.

The central portion of blank 26 comprises a front panel 28, a bottom panel 30 and a back panel 32. Each of these panels are rectangular, with panels 28, 32 being equal in size. Front and back panels 28, 32 are hingedly coupled to bottom panel 30 at opposite end edges thereof along fold lines 34, 36, respectively.

Front panel 28 has first and second rectangular side flaps 38, 40 hingedly coupled at its opposite side edges along fold lines 42, 44, respectively. Bottom panel 30 has first and second rectangular side flaps 46, 48 hingedly coupled at its opposite side edges along fold lines 50, 52, respectively. Similarly, back panel 32 has first and second rectangular side flaps 54, 56 hingedly coupled to its opposite side edges along fold lines 58, 60, respectively.

A generally rectangular inner top panel 62 is hingedly coupled at an end edge of front panel 28 remote from bottom panel 30 along a fold line 64. First and second generally rectangular side flaps 68, 66 are hingedly coupled at opposite side edges of inner top panel 62 along fold lines 70, 72. Rectangular openings 74, 76 are formed in inner top panel 62 and its side flaps 66, 68 such that openings 74, 76 span fold lines 70, 72, respectively.

A rectangular outer top panel 78 is hingedly coupled at an end edge of back panel 32 remote from bottom panel 30 along a fold line 80. First and second rectangular side flaps 82, 84 are hingedly coupled at opposite side edges of outer top panel 78 along fold lines 86, 88, respectively.

Outer top panel 78 is divided into three panels by a score line 90 and a fold line 92 to define a wall panel 94, an outer handle panel 96 and an inner handle panel 98. Each of these panels is rectangular. Score line 90 comprises a series of perforations formed in the material of blank 26 such that the blank material may be easily separated along line 90. Score line 90 is parallel to fold line 80 and extends entirely across outer top panel 78 terminating in side flaps 82, 84 between fold lines 86, 88 and the free edges 100, 102 of side flaps 82, 84 remote from top outer panel 78. Fold line 92 extends entirely across outer top panel 78 and side flaps 82, 84, parallel to score line 90 and between score line 90 and free end edge 104 of outer top panel 78. The portions of fold line 92 in side flaps 82, 84 comprise score lines.

Figure 6:
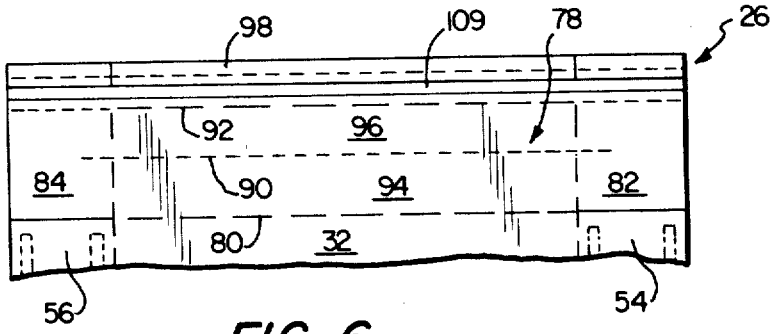
FIG. 6 is a partial plan view illustrating the exterior surface of a blank for forming the carton of FIG. 1 according to a second embodiment of the invention.
Figure 7:
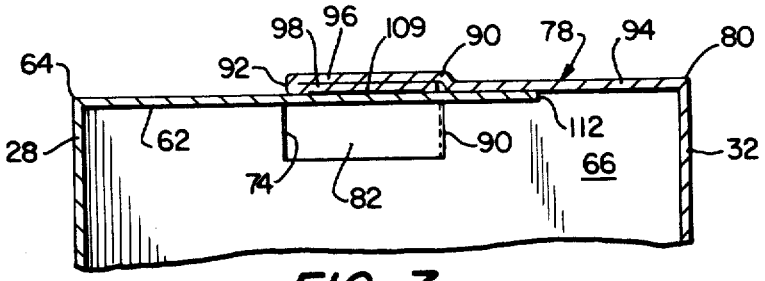
FIG. 7 is a partial, side elevational view in cross section illustrating the carton formed from the blank of FIG. 6.
Figure 8:
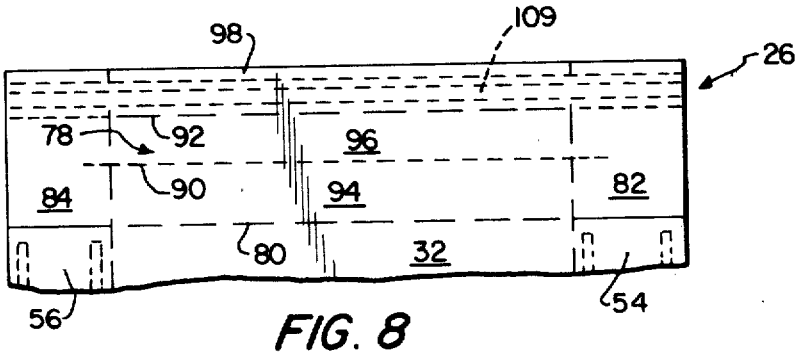
FIG. 8 is a partial, plan view illustrating the exterior surface of a blank for forming the carton of FIG. 1 according to a third embodiment of the invention.
Figure 9:
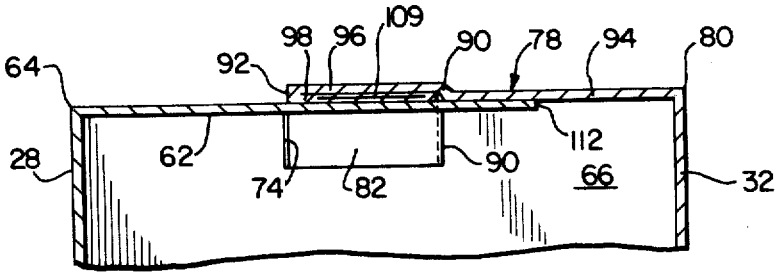
FIG. 9 is a partial, side elevational view in cross section illustrating the carton formed from the blank of FIG. 8.

Two elongated reinforcing members 106, 108 can be secured to the interior surfaces of outer handle panel 96 and side flaps 82, 84 such that they extend parallel to and between score line 90 and fold line 92 as illustrated in FIGS. 3 and 5. These reinforcing members comprise strips of string, tape or other suitable material to strengthen or reinforce the handle. Alternatively, a single strip of reinforcing tape 109 can be secured to the exterior surface of inner handle panel 98 as illustrated in FIGS. 6 and 7, or between the plies of the paperboard forming inner handle panel 98 as illustrated in FIGS. 8 and 9.

Adjacent side flaps are separated by slits 110 to permit the side flaps to be folded independently of one another. Respective pairs of slits 110 are formed colinearly with each of the fold lines 34, 36, 64, 80.

Carton 10 is formed from blank 26 illustrated in FIG. 5. Inner handle panel 98 is folded about line 92 to overlie the interior surface of outer handle panel 96 and reinforcing members 106, 108. An adhesive is applied to inner handle panel in area 114 adjacent free end edge 104 to adhere inner handle panel 98 to outer handle panel 96. Panels 28, 62 and flaps 38, 40, 66, 68 are then folded about line 34 to overlie the interior surfaces of panels 30, 32 and flaps 46, 48, 54, 56. Thereafter, outer top panel 78 is folded about line 80 to overlie the exterior surface of inner top panel 62 with handle panel 24 overlying openings 74, 76. Panel 62 is attached to the interior surface of wall panel 94 and side flaps 66, 68 are attached to side flaps 82, 84, respectively, by an adhesive applied to the area 116 on the exterior surfaces of panel 62 and side flaps 66, 68 adjacent free edge 112. Blank 26 is now in a partially assembled, collapsed condition of carton 10 in which it may be easily and efficiently shipped and stored.

Immediately prior to filling the carton, panels 78, 32, 30, 28, 62 are folded about lines 80, 36, 34, 64 to form a tube of rectangular cross section which is open at its ends. Once blank 26 has been formed into a tube, one side can be closed and the carton filled with the desired contents, the other side being closed after filling. Alternatively, both sides can be closed simultaneously or sequentially after the carton has been packed.

Since the folding of blank 26 to close each side of the partially assembled carton is similar, only the closing of one side will be described in detail. Side flaps 84, 68 are folded about lines 88, 72, respectively, until they depend perpendicularly from top panels 78, 62. Side flap 48 is folded about line 52 until it extends perpendicularly upwardly from bottom panel 30. Side flap 56 is then folded about line 60 to overlie outer top panel side flap 84 and bottom side flap 48, and is adhered thereto by adhesive applied to areas 118 on the interior surface of side flap 56. Thereafter, side flap 40 is folded about line 44 to overlie side flap 56 and side flaps 84, 48, as illustrated in FIGS. 1 and 4, and is adhered thereto by adhesive applied to areas 120 on the interior surface of side flap 40.

The other side of carton 10 is folded in a similar manner. In this manner, top panels 62, 78 form top wall 12, bottom panel 30 forms bottom wall 14, front panel 28 forms front wall 16, back panel 32 forms back wall 18, side flaps 40, 48, 56, 68, 84 form side wall 20, and side flaps 38, 46, 54, 66, 82 form side wall 22.

During shipping and storage of carton 10, score line 90 remains intact and retains handle panel 24 in place flat against inner top panel 62 as illustrated in FIGS. 1, 3 and 4. When the consumer needs to use handle panel 24 (i.e., handle panels 96, 98) to carry carton 10, the handle panel is severed from the remaining portion of outer top panel 78 (i.e., wall panel 94) along score line 90. This permits the consumer to lift carton 10 upwardly in a plane of the center of gravity of carton 10 such that carton 10 will hang down vertically and evenly under its weight from the consumer's hand without bumping into the consumer's leg.

Since score line 90 extends downwardly beyond the corners between top wall 12 and side walls 20, 22 and the side flaps 82, 84 are adhered to side flaps 56, 54, the stresses at the ends of handle panel 24 will be in a vertical direction, rather than in a horizontal direction. Thus, the stresses in handle panel 24 subject handle panel 24 to tension forces, rather than shear forces, to maximize the load carrying capacity of the handle panel.

The handle panel is strengthened by the double thickness of paperboard formed by inner and outer handle panels 98, 96 and by reinforcing members 106, 108 or reinforcing member 109 provided in the handle. The reinforcing members are particularly advantageous for supporting such heavy contents as 24 beverage cans. For relatively low weight contents, such as diapers and sanitary napkins, the reinforcing members may be eliminated.

By forming openings 74, 76 in inner top panel 62 and side flaps 66, 68 and aligned with handle panel 24, the ends of handle panel 24 may extend into carton 10 to contact the carton contents. For contents such as cylindrical cans, this arrangement permits the handle panel to roll and bend about the cylindrical surfaces of the cans to tighten them together in a solid block and to prevent the handle from cracking at fold lines 86, 88. Although carton 10 may be formed without openings 74, 76, the ends of handle panel 24 will tend to form additional creases at the terminations of score line 90. These additional creases are disadvantageous since they tend to form cracks and handle failure.

Since the handle is formed from a folded over edge of blank 26, the carton may be completely sealed about the contents. This arrangement is advantageous for beverages since the carton functions as an insulator to maintain the beverages at a relatively low temperature.

Although the invention has been described in considerable detail with particular reference to a certain preferred embodiment thereof, variations and modifications can be effected within the spirit and scope of the invention as defined in the appended claims.

What is claimed is:

1. A carton, comprising top and bottom walls;

front, back and side walls connecting said top and bottom walls;

said top wall having inner and outer panels extending from said front and back walls, respectively, and being overlapped and secured together;

first and second side flaps extending from opposite side edges of said outer top panels and secured to the inside of said side walls;

inner and outer elongated handle panels foldably connected together and formed from portions of said outer top panel and said side flaps, extending substantially parallel to and equally spaced from the top edges of said front and back walls and substantially perpendicular to said side walls, said outer handle panel being defined by a perforated score line formed in said outer top panel which extends entirely across the length of said outer top panel and substantially parallel to said top edges of said front and back walls and only partially across each of said side flaps and by a handle fold line formed in said outer top panel and extends parallel to said score line and across the entire length of said outer top panel and said side flaps and is located between said score line and the top edge of said front panel, said inner handle panel being defined between said handle fold line and by said perforated score line, when severed, of said outer top panel and underlying and being secured to said outer handle panel.

2. A carton according to claim 1, wherein openings are formed in said inner top panel and said side flaps coupled thereto spanning junctures therebetween and underlying said handle panels.

3. A carton according to claim 1, wherein at least one reinforcing member extends along the length of and is secured to one of said inner and outer handle panels.

* * * * *